United States Patent [19]

Hadlick, Jr.

[11] 4,203,210

[45] May 20, 1980

[54] SHINGLE STRIPPER

[76] Inventor: Paul E. Hadlick, Jr., 11527 Monticello Ave., Silver Spring, Md. 20902

[21] Appl. No.: 950,557

[22] Filed: Oct. 12, 1978

[51] Int. Cl.[2] ..... A47L 13/02

[52] U.S. Cl. ..... 30/172; 254/131.5; 294/54

[58] Field of Search ..... 254/21, 25, 131, 131.5; 145/1 A; 30/169, 171, 172; 294/54

[56] References Cited

U.S. PATENT DOCUMENTS

| | | | |
|---|---|---|---|
| 1,218,145 | 3/1917 | Whittier | 145/1 A |
| 2,769,236 | 11/1956 | Phillips et al. | 254/131 |
| 4,086,699 | 5/1978 | Olkkola | 254/131.5 |

FOREIGN PATENT DOCUMENTS

| | | | |
|---|---|---|---|
| 831930 | 6/1938 | France | 254/131.5 |

*Primary Examiner*—Robert C. Watson
*Attorney, Agent, or Firm*—Harold Gell

[57] ABSTRACT

A manually manipulated tool incorporating a forward, serrated edge adapted to lift shingles and engage roofing nails so that they may be pried from the sub-roof by action of the tool against a fulcrum that is dimensioned and positioned to prevent injury to the users hand while operating the tool and provide an optimum fulcrum point for maximum leverage without presenting a surface which will mar the sub-roof.

10 Claims, 4 Drawing Figures

SHINGLE STRIPPER

THE INVENTION

This invention relates to a hand manipulated tool for stripping roofing shingles from a sub-roof and removing roofing nails therefrom.

BACKGROUND OF THE INVENTION

Contemporary single family and multiple family dwelling construction utilizes an outer roof covering comprised of shingles that may be fabricated from wooden shakes or a variety of man made materials such aspalt impregnated fibrous panels. Regardless of the type of materials utilized in constructing the shingles, they deteriorate with age and are prone to wind damage, necessitating their periodic removal and replacement. Because the shingles are assembled on a roof in an overlapping fashion, it is necessary that they be peeled up toward the apex of the roof. Since the shingles lie flat and have a plurality of nails securing them to the sub-roof, this is an all but impossible task to accomplish by hand. Therefore, numerous tools have been provided to strip the shingles from the roofs but all such tools to date suffer from various drawbacks.

For instance, the tool described in U.S. Pat. No. 4,086,699 on "Roof Stripping Tool" issued to E. Olkkola results in a relatively lightweight tool but it fails to provide an adequate means to remove nails. For instance, in FIGS. 3 and 5 of Olkkola you will note that a sharp, relatively broad edge is provided for slipping under the tiles. Due to the width of this front edge, many nails are sheared off or the tool is stopped from its forward, stripping motion. If the nails are sheared, no head remains and they cannot easily be removed from the sub-roof. If the cut nails are allowed to remain in the sub-roof, they will damage subsequent new roofing. Another drawback in tools such as that disclosed in the Olkkola patent is the angle between the blade and handle. As can be seen in FIGS. 1 and Column 2 Lines 43 et seq the force vector in the forward or stripping motion loses significant force due to the downward vector caused by the angle of the tool handle and the blade. This results in an excessive force being utilized by the tool operator, making the work much harder than it need be and, in many instances due to the downward force applied, resulting in damage to the sub-roof.

A. Phillips et al, in U.S. Pat. No. 2,769,236 on "Tile Removing Tools" illustrates another hand held tool for stripping tiles. Note that this tool provides no means for prying nails from the roof and results in all of the nails being sheared, creating problems similar to that described with the sheared nails left by the Olkkola device.

C. Knowles, in U.S. Pat. No. 3,113,758 on "Fulcrum Attachment for Blade Implements" provides an adapter for a spade which will permit the spade to be used to pry shingles from the roof. Note that using a spade in the manner described pries shingles but fails to ensure that roofing nails will be pried up. Devices such as the Knowles device will either shear nails as the Phillips or Olkkola devices or else bind in the roof between the shingles to be removed and the sub-roof.

E. Saucier Sr. et al, U.S. Pat. No. 3,836,119 on "Roof Covering Removing Tool" is another example of a roof stripping tool which results in sheared roofing nails. This tool suffers an additional drawback in that it does not include an adequate fulcrum point to permit prying up the roofing materials by downward motion of the handle. To use the Saucier tool, the tool is pushed forward, using the cutting edge of the tool as a fulcrum point. This action results in significant damage to the sub-roof, see for instance FIG. 4.

W. Soliverius, U.S. Pat. No. 3,818,593 on "Blade For Material Stripping Apparatus" discloses a stripping tool utilizing an extremely heavy blade which in most embodiments is incorporated in a wheeled, vehicle like affair powered by a mechanical driving force. FIG. 6 of this patent illustrates a hand manipulated version of the tool but due to its structure it is relatively unwieldy. The stripping blade is angled so that stripping functions and nail removal is created as the tool is slid forward across a sub-roof surface, see FIG. 7. This necessitates an extremely forceful action along the plane of the roof and the required force can only be achieved in the manual tool when an extremely strong operator exerts large amounts of energy to slide the tool along the roof plane. As can be seen in the various illustrations of the patent, no fulcrum means are provided and if the tool engages resistant nails, any action to pry them out will be hampered due to the lack of a sufficiently broad fulcrum point. For instance, in FIG. 6 if the handle is used as a lever to pry out nail H, it appears as if a fulcrum point might exist at the top apex of the blade. If this is the case, the narrow fulcrum point will result in considerable roof damage.

C. Erickson Jr., U.S. Pat. No. 3,074,694 on "Roof-Nail Spud" illustrates a tool which is adapted primarily to remove roofing nails. It is comprised of a plurality of wedge plates and due to their long, individual blade like effect on roof surfaces will cause considerable damage to sub-roofs if used as a shingle stripping tool. The construction of the Erickson tool, is such that it necessitates a relatively narrow tool that is ineffectual in removing standard roofing shingles since its use will result in breaking the shingles up into a number of small pieces that are not completely separated from each other and thus pieces of loose roofing is secured to the roof by portions of the shingle that have not been sufficiently stripped therefrom.

OBJECTIVES OF THE INVENTION

In view of the obvious inability of the prior art roof stripping tools to provide a device which may be manually employed to strip shingles from a roof and remove nails effectively with a minimal amount of exertion by the user, it is a primary objective of the present invention to provide a lightweight hand manipulated tool that may be employed with a minimal amount of expended energy by the user.

A further objective of the present invention is to provide a roof stripping tool that may be operated at a small angle with respect to the plane of the roof so that the maximum amount of energy expended by the user is directed along the plane of the roof to ensure shingle removal with a minimal amount of effort and without unduly fatiguing the operator.

A still further objective of the present invention is to provide a roof stripping tool that may be utilized at a small angle with respect to the plane of the roof and which incorporates a fulcrum design so that it will not damage the sub-roof but will prevent the handle portion of the tool from approaching the roof surface close enough to injure the hands of the tool operator.

Another objective of the present invention is to provide a roof stripping tool which incorporates a plurality of serrations along the front edge which are adapted to force roofing nail shanks into grooves without shearing the nails and provide a narrowing channel whereby the nail shank may be engaged by the tool so that they may be pried upward and out of the sub-roof.

It is a still further objective of the present invention to provide nail engaging means on the front of the roof stripping tool which will not shear nail shanks and which will cause the automatic lateral movement of the tool as it is thrust forward by the user so that the nail will be properly engaged in the apex of the wedges of the serrations so that it may be pried from the roof.

Another objective of the present invention is to provide a roof stripping tool which may be easily manufactured from currently available mass produced items so that the end product may be provided at a minimal cost.

A further objective of the present invention is to provide a roof stripping tool which is lightweight, sturdy and not subject to catastrophic failure modes.

The foregoing and other objectives of the invention will become apparent in light of the drawings, specification and claims contained herein.

SUMMARY OF THE INVENTION

Presented hereby is a roof stripping tool in the form of a square ended spade having a plurality of serrations cut at a predetermined small angle in the forward end so that the spade may be slid under roof shingles and engage nails securing the shingles to the sub-roof. The serrations are cut at a small angle so that lateral movement will be readily imparted to the spade as it is slid forward and engages a nail. The lateral movement is required so that the nail will bind in the narrowing apex of the serration so that it may be pried from the roof. A tubular structure is secured across the back of the spade to function as a fulcrum which will provide a relatively broad footprint on the sub-roof so that the sub-roof will not be damaged as the tool is used to pry nails therefrom. The fulcrum is positioned so that it will prevent the handle from approaching the roof during the forward thrust of the tool close enough to damage the users hands.

DESCRIPTION OF THE INVENTION

Figure 1:
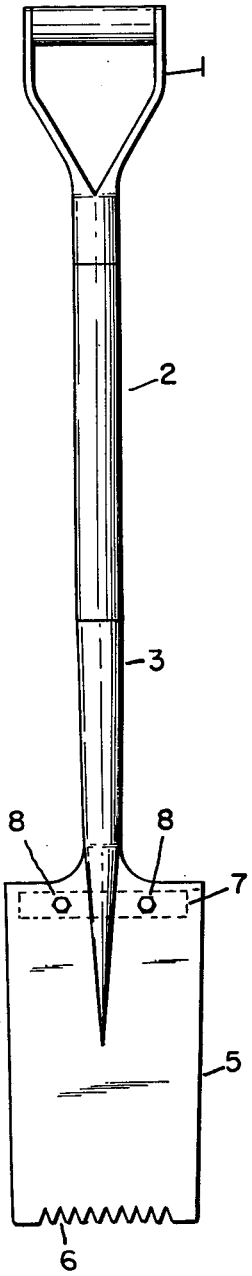
FIG. 1 is a top view of the roof stripping tool in a preferred embodiment of the invention.

FIG. 1 depicts a preferred embodiment of the present invention. It is comprised of a standard, square end spade incorporating a D handle 1 affixed to a wooden dowel like shaft 2 which is secured in a rolled, tubular portion of the spade blade 3. The D handle 1 and rolled portion of the spade blade 3 are secured to the shaft 2 by rivets 4 or other securing means depicted in FIG. 1.

Figure 2:
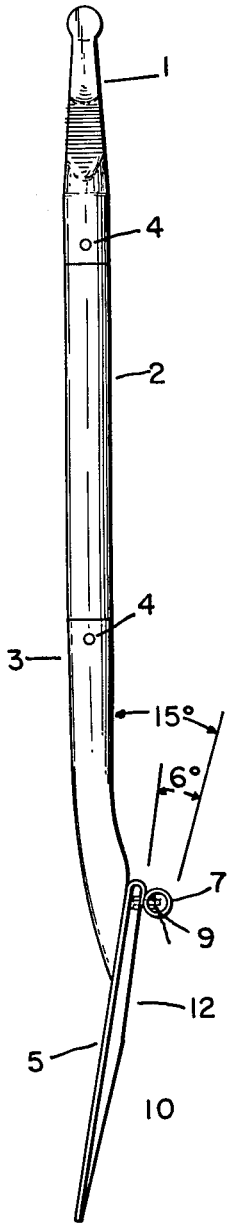
FIG. 2 is a side view of a preferred embodiment of the present invention.
Figure 3:
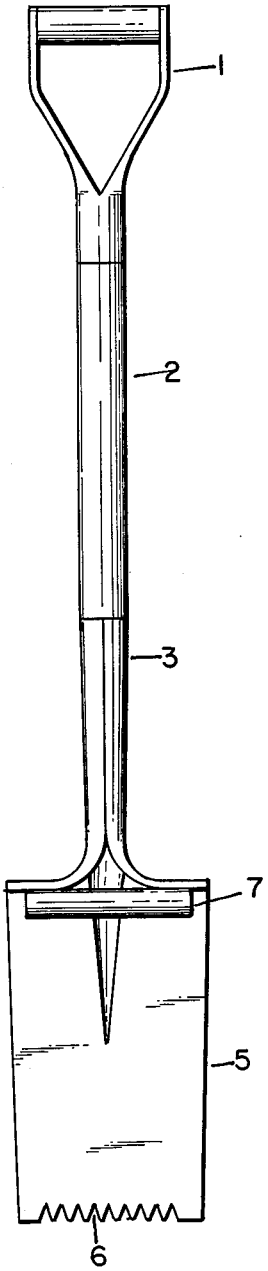
FIG. 3 is a bottom view of a preferred view of the roof stripping tool of the present invention.

The spade blade 5 has a plurality of serrations 6 cut across the front edge to function as nail engaging means so that nails may be pried from the roof through the use of the fulcrum 7 illustrated in FIGS. 1, 2 and 3. The fulcrum is a tubular structure fabricated from a length of one inch pipe secured to the back of the shovel approximately ⅝ of an inch from the rear edge or heel of the spade blade by a pair of hex head, ¼ inch bolts ⅝ inch long 8 and lock washers and nuts 9. The one inch pipe may also be secured to the back of a shovel by welding, riveting or other fastening methods. However, the pipe must be secured so that the rounded exterior is not disturbed at the forward or bottom circumferences. The pipe circumference must be smooth in these areas so that it will not mar the sub-roof as the tool is driven forward and so that it will provide a relatively broad, soft "footprint" when the tool is used to pry nails upward.

It is essential that the angle between the tool shank 2 and the sub-roof be kept as small as possible, 15 degrees or less, so that the maximum force of an operators thrust with the tool will be directed along the plane of the sub-roof and the vector force perpendicular to the sub-roof will be minimal. The perpendicular vector force must be minimized to prevent damage to the sub-roof. While maintaining the maximum force vector along the plane of the roof, it is essential that clearance for the users hand' be maintained between the roof and the shank 2 of the tool in the grasping region and the D handle 1. The use of a one inch diameter fulcrum ensures the required spacing by causing the tool to assure the optimum angle of 6 degrees.

In addition to providing a safety feature, the selection of a fulcrum 9 having a diameter of approximately one inch is mandated by the angle between the flat, forward section 10 of FIG. 2 of the spade and rear section 12 to which the fulcrum is secured. The fulcrum 9 must be of a diameter and positioned so that the flat, forward portion 10 of the spade blade 5 is parallel to the sub-roof when the fulcrum is resting on the sub-roof.

The tool is used by grasping it about the shank 2 and by the D handle 1 and sliding it along the roof so that the flat portion of the blade 10 of FIG. 2 and the bottom of the fulcrum 7 engage the roof. This action peels shingles in an upward direction and when the serrations 6 engage roofing nails, the angle of the serrations cause the blade to move in a lateral direction and the spade comes to rest with the nail 11 of FIG. 4 at the apex of a serration. The spade handle is then forced towards the roof and the fulcrum 7 causes the forward edge of the spade blade 5 to raise and pop the nail from the sub-roof. The removed shingles may then be discarded by using the shovel in the same fashion one would use a shovel to throw a shovel full of dirt into a wheelbarrow.

Figure 4:
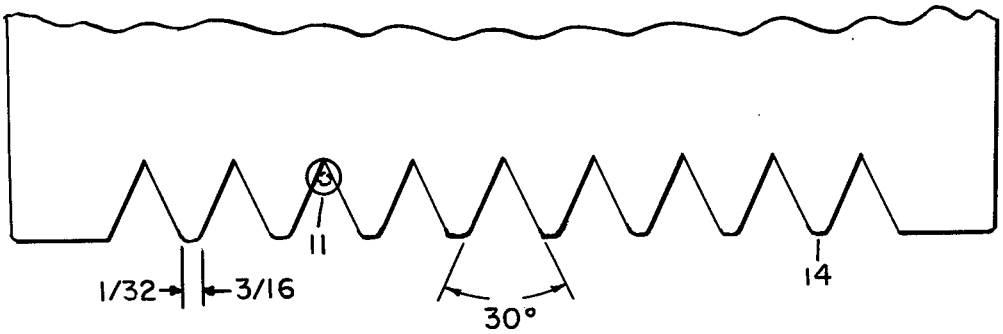
FIG. 4 is a detailed view of the cutting and nail engaging forward edge of the roof stripping tool.

The angle at which the serrations are cut is critical. If the angle is too narrow, the nail will not slide sufficiently far back into the apex of the serration and when the nail is pried up the head may bend due to the minimal amount of blade surface engaging the underside of the head. On the other hand, if the angle is too large, the nail may bend or be sheared off as opposed to causing lateral motion of the spade due to the vector forces resulting from the nail shank engaging the relatively flat surface of the wide angled serration. Therefore, it has been determined through design and experimentation that the optimum angle of the serrations should be 30° as illustrated in FIG. 4.

Another important feature of the invention is the location of adjacent serrations. The serrations should be positioned close enough together so that the resulting points 12 are less than the diameter of a roofing nail and rounded slightly at the edges so that if a nail is struck squarely by a point between serrations, it will not be sheared off. The optimum width of the points 14 is between 1/32 and 3/16 inch. Instead, it will deflect the shovel either to the left or right and cause continued lateral motion of the blade until the blade is positioned about the nail 11 as illustrated in FIG. 4. It is important that the points created between the serrations be maintained in a relatively blunt but narrow configuration. If the points between serrations are too broad, they will result in sheared nails and if the points between serrations are allowed to become too narrow and approach a pointed configuration, they will result in damage to the sub-roof by gouging the roof structure as the tool is slid forward.

In an alternate embodiment of the present invention, a long handled spade may be utilized as the basic material from which the tool is manufactured.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A roof stripping tool, comprising:

a blade, including a forward flat section and a rear section of approximately equal length forming an interior angle of greater than 0 degrees but less than 45 degrees with the plane of said forward section;

said forward section of said blade including a plurality of nail shank engaging "V" shaped grooves across the front edge thereof; and a fulcrum means secured to the underside of said rear section of said blade, said fulcrum means spanning approximately the total width of said rear section of said blade and extending down from said rear section of said blade to meet but not pass the plane of said forward section for positioning said forward section parallel to the roof plane.

2. A roof stripping tool as defined in claim 1 wherein the interior angle of said "V" shaped grooves is less than 45 degrees.

3. A roof stripping tool as defined in claim 1 wherein the interior angles of said "V" shaped grooves are 30 degrees.

4. A roof stripping tool as defined in claim 2 wherein said distance between the open edges of adjacent ones of said "V" shaped grooves are at least 1/32 inch but 3/16 inch or less.

5. A roof stripping tool as defined in claim 3 wherein said distance between the open edges of adjacent ones of said "V" shaped grooves are at least 1/32 inch but 3/16 inch or less.

6. A roof stripping tool as defined in claim 1 wherein said interior angle between said forward and rear section planes of said blade is greater than 0 degrees but less than 15 degrees.

7. A roof stripping tool as defined in claim 1, further including a handle secured to said rear section of said blade and extending in a plane forming an interior angle of greater than 0 degrees with the plane of said rear section of said blade and an interior angle with the plane of said forward section of said blade greater than that formed between the handle plane and rear section plane.

8. A roof stripping tool as defined in claim 7, wherein said interior angle between said handle plane and said forward section plane is between 6 and 15 degrees.

9. A roof stripping tool as defined in claim 1, wherein said fulcrum means is a tubular structure positioned with its bore parallel to the front edge of said forward section of said blade.

10. A roof stripping tool as defined in claim 6 wherein: said interior angles of said "V" shaped grooves are 30, plus or minus 14 degrees; said distance between the open edges of adjacent areas of said "V" shaped grooves is at least 1/32 inch but less than 3/16 inch; and further including a handle secured to said rear section of said blade and extending in a plane forming an interior angle of greater than 0 degrees with the plane of said rear section of said blade and an interior angle with the plane of said forward section of said blade greater than that formed between the handle plane and rear section plane.

* * * * *